US005799473A

United States Patent [19]

Goblet

[11] Patent Number: 5,799,473

[45] Date of Patent: Sep. 1, 1998

[54] SADDLE FOR HORSES

[75] Inventor: Laurent Goblet, Paris, France

[73] Assignee: Hermes S.A., Paris, France

[21] Appl. No.: 617,845

[22] PCT Filed: Jul. 7, 1995

[86] PCT No.: PCT/FR95/00917

§ 371 Date: Mar. 13, 1996

§ 102(e) Date: Mar. 13, 1996

[87] PCT Pub. No.: WO96/02460

PCT Pub. Date: Feb. 1, 1996

[30] Foreign Application Priority Data

Jul. 13, 1994 [FR] France ..... 94 08761

[51] Int. Cl.[6] ..... B68C 1/02

[52] U.S. Cl. ..... 54/44.1

[58] Field of Search ..... 54/44.1, 46.1, 54/44.7

[56] References Cited

U.S. PATENT DOCUMENTS

| | | | |
|---|---|---|---|
| 443,241 | 12/1890 | Northrup | 54/44.1 |
| 1,213,329 | 1/1917 | Beal | 54/44.1 |
| 5,191,752 | 3/1993 | Murphy | 54/44.7 X |
| 5,195,306 | 3/1993 | Hadlock | 54/44.7 |

FOREIGN PATENT DOCUMENTS

| | | |
|---|---|---|
| 0 466 270 | 1/1992 | European Pat. Off. . |
| 2 597 463 | 10/1987 | France . |

*Primary Examiner*—Robert P. Swiatek
*Attorney, Agent, or Firm*—Young & Thompson

[57] ABSTRACT

A horse saddle, particularly for playing polo, comprising at least one transverse fastening through-hole (16) fully built into the saddle under the outer top surface (18) of the seat (7) for guiding and vertically supporting at least one girth or overgirth fed through said hole.

29 Claims, 11 Drawing Sheets

SADDLE FOR HORSES

The invention concerns a saddle for horses.

It is well known that, in certain cases, it is necessary to reinforce or improve safety when fastening a saddle on a horse. This is the case, for instance, with the game of polo in which the player is often in an offset and unbalanced position. Analogous circumstances may occur during training or during certain horse-riding activities or training.

For this purpose, the use and implementation of an overgirth is well-known. This overgirth "doubles" the girth with which any conventional saddle is provided. It is reminded here that both end parts for fastening the girth onto the saddle proper are interposed between the flaps and the knee rolls, on either side of the saddle, where they are attached to fastening means provided at both ends of a strap set across the saddle-bow and attached thereon by means of nails or equivalent means.

Such an overgirth is an accessory at the user's disposal. It is added to the saddle proper and is set crosswise over it, i.e. it is applied onto the visible outer sides of the seat, skirts and flaps.

This creates, on the seat and on the flaps where the overgirth is placed, an extra thickness which corresponds to the thickness of the overgirth and two protruding edges corresponding to the two free longitudinal edges of the overgirth. This extra thickness and these protruding edges are located crosswise with respect to the saddle.

This situation is inherent in the conventional design of horse saddles which do not allow for the incorporation of an overgirth due to their structures which besides are traditionally well-established.

Now there are many drawbacks with the presence of an overgirth provided in the known manner, and particularly the obvious lack of comfort for the person who rides the horse (rider, polo player, etc.) since his (or her) buttocks rest on the extra thickness, and the inner sides of his/her thighs rub against the overgirth free edges, especially during a longitudinal relative motion frontwards or backwards with respect to the saddle. Another drawback is that the position of the overgirth along a longitudinal direction is not necessarily the best one, since no indication is given for this position and the overgirth is not guided. Lastly, this position may change following a relative longitudinal shift of the overgirth with respect to the saddle.

The invention is thus intended to eliminate these drawbacks.

For this purpose, it proposes a saddle for horses characterised in that it has at least one crosswise, transverse retaining or support passage, arranged below the seat's upper outer face and totally built into the saddle, whose functions consist in providing a guided transversal passage from one side to the other, on the one hand, and the downwards vertical support of at least one girth or overgirth, on the other hand.

According to other characteristics, the saddle includes either a single passage for one girth and/or one overgirth, or two passages which are distinct and separated from each other for one girth and one overgirth.

The passage is provided in the saddle-bow.

More specifically, the passage is defined towards the top by the longitudinal girth(s) attached to the saddle-bow frame; towards the bottom by the two rigid longitudinal straps of the saddle-bow frame; towards the pommel and the cantle by braces ensuring the required spacing between said longitudinal girths and said rigid longitudinal straps of the frame, respectively.

The side openings of the passage are normally concealed by the skirts since they are placed underneath.

The passage is located in or near the transversally narrowest mid-portion of the saddle-bow.

According to a first alternate embodiment, the saddle includes a single passage for an overgirth adjacent to a crosswise strap located towards the pommel and covering the saddle-bow's longitudinal girths, said strap being intended for the removable fastening of the saddle girth, using fastening means.

In this case a slit or a loop for the overgirth is arranged in the flap, substantially located at the base of the passage for the overgirth.

Besides, this first alternate embodiment also provides, preferably an L-shaped stirrup leather arch which only lets the stirrup leather in as a result of a bottom-to-top motion between the stirrup leather arch and the flap and only lets it out by means of an opposite motion only.

This invention also concerns a saddle according to this first alternate embodiment with its overgirth built into the thickness of the saddle.

Such a saddle is more particularly intended for the game of polo.

In such a saddle, the overgirth does not create an extra thickness with respect to the seat.

According to a second alternate embodiment, the saddle includes a single passage for the girth, this passage being located towards the pommel and the stirrup leather arches. In this case, the girth passes crosswise through the saddle, making the transversal strap provided with fastening means unnecessary.

It is a further object of this invention to provide for a saddle according to this second alternate embodiment, with a built-in girth.

Such a saddle may or may not include an overgirth.

Finally, according to a third alternate embodiment, the saddle includes a single or double passage for the girth and the overgirth.

It is a further object of this invention to provide for a saddle according to this third alternate embodiment, with a built-in girth and overgirth.

The present invention will be fully understood upon reading the description which follows.

Figure 1:
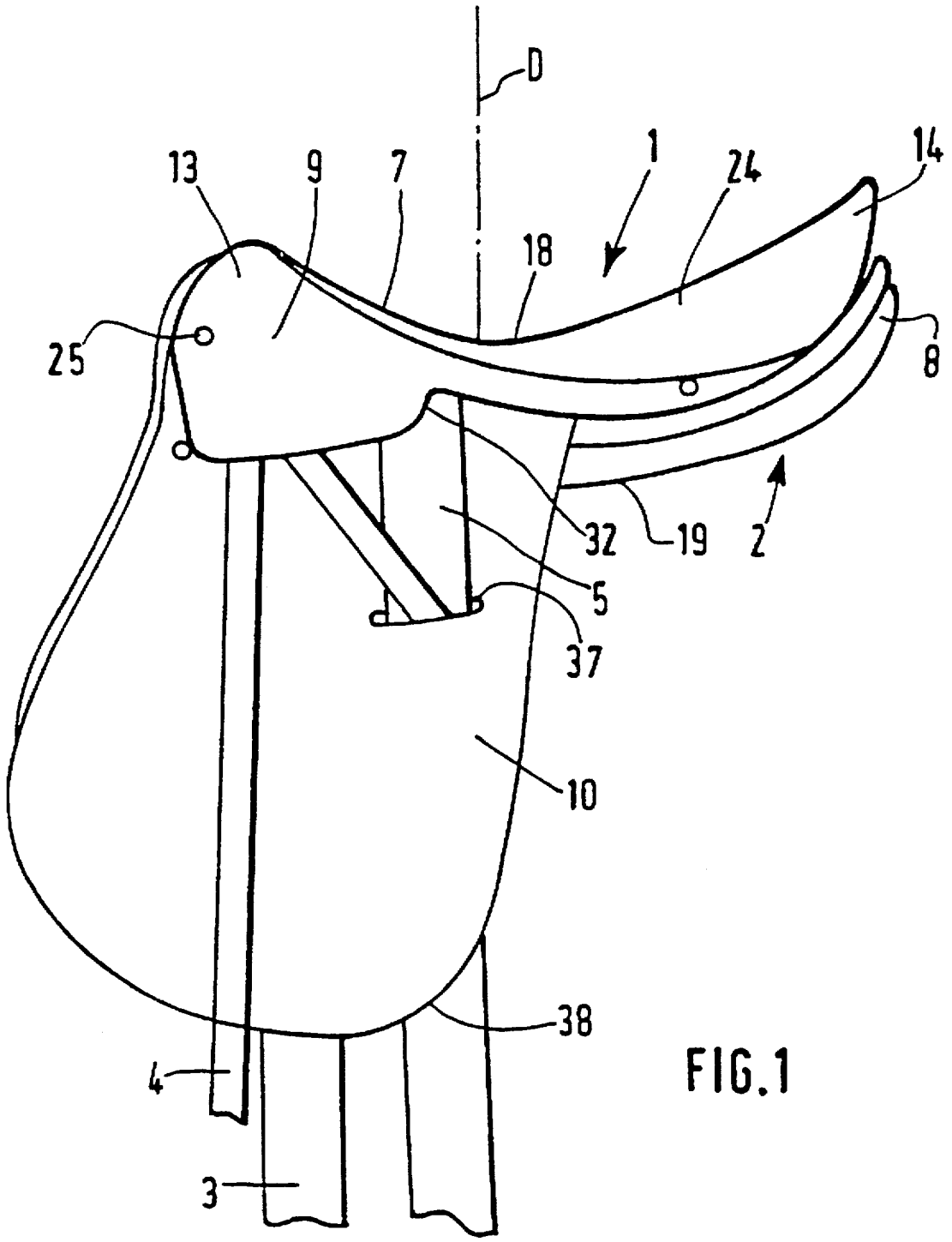
FIGS. 1, 2 and 3 are three side elevation views of a saddle according to a first alternate embodiment of the invention, with (i) a girth, a stirrup leather and a built-in overgirth; (ii) a built-in overgirth only; and (iii) the saddle proper without girth, stirrup leather or overgirth, respectively.
Figure 2:
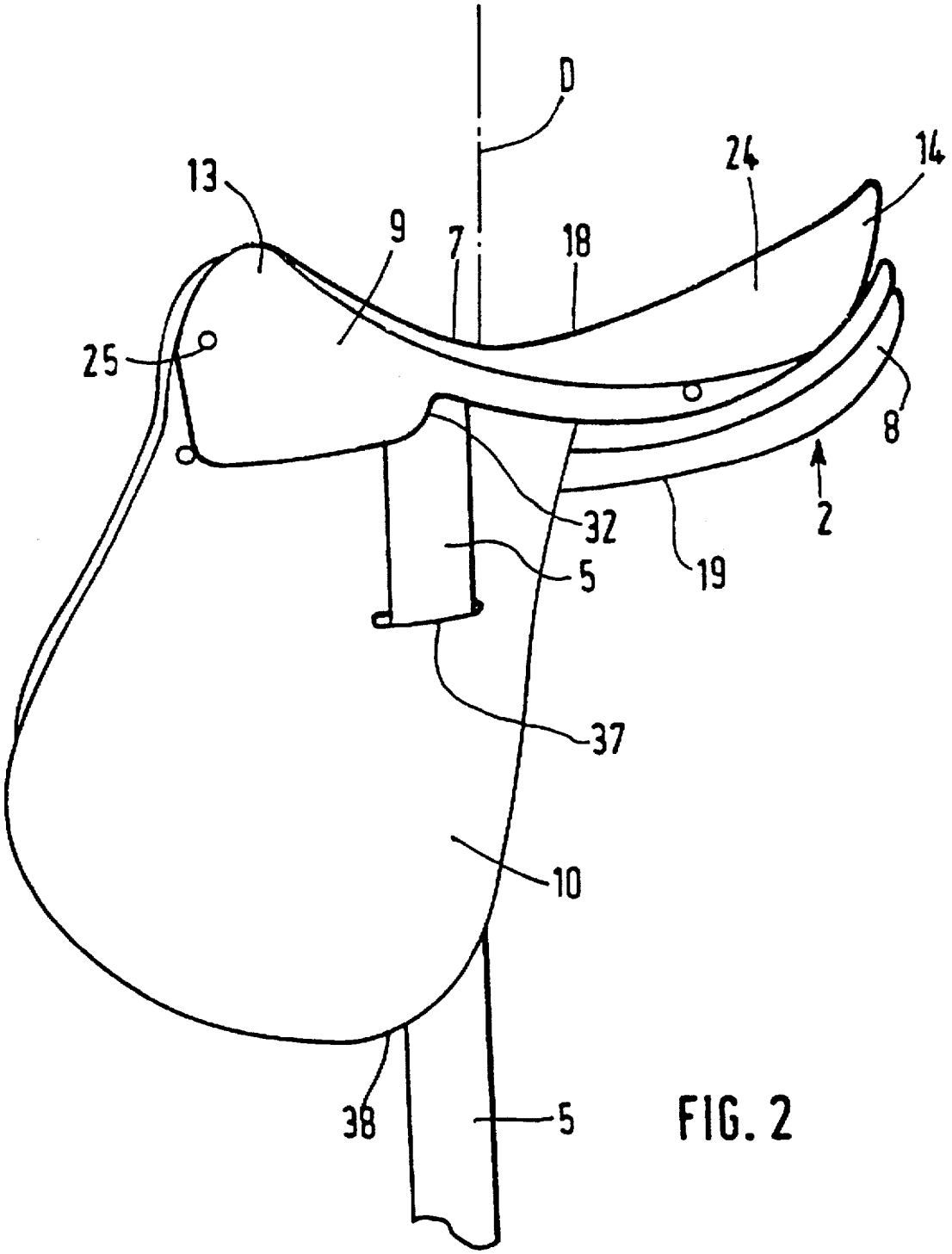
Figure 3:
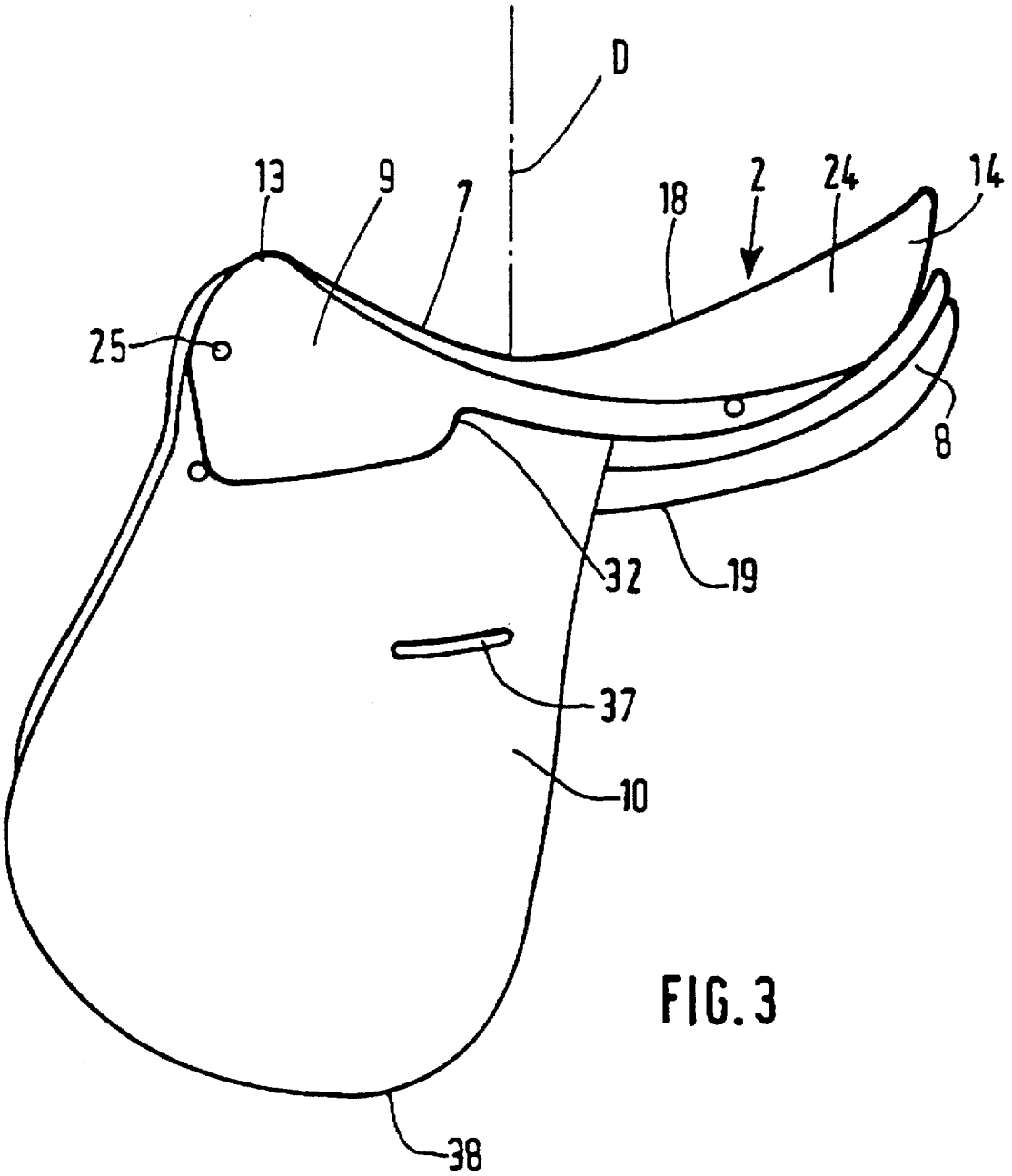
Figure 4:
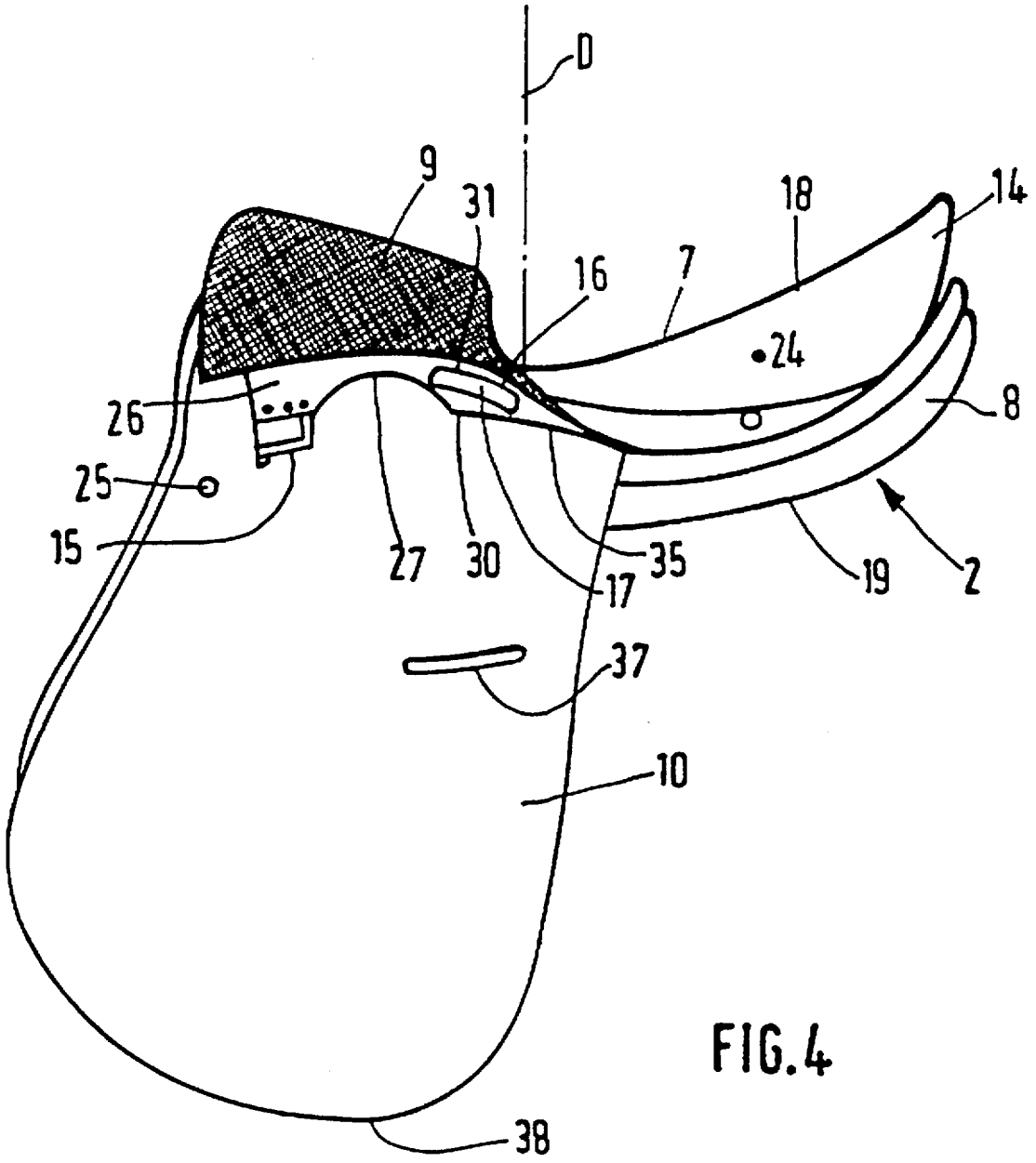
FIGS. 4 and 5 are two side elevation views of the saddle shown in FIG. 3, with (i) the skirt turned upwards and (ii) the flap also turned upwards, respectively.
Figure 5:
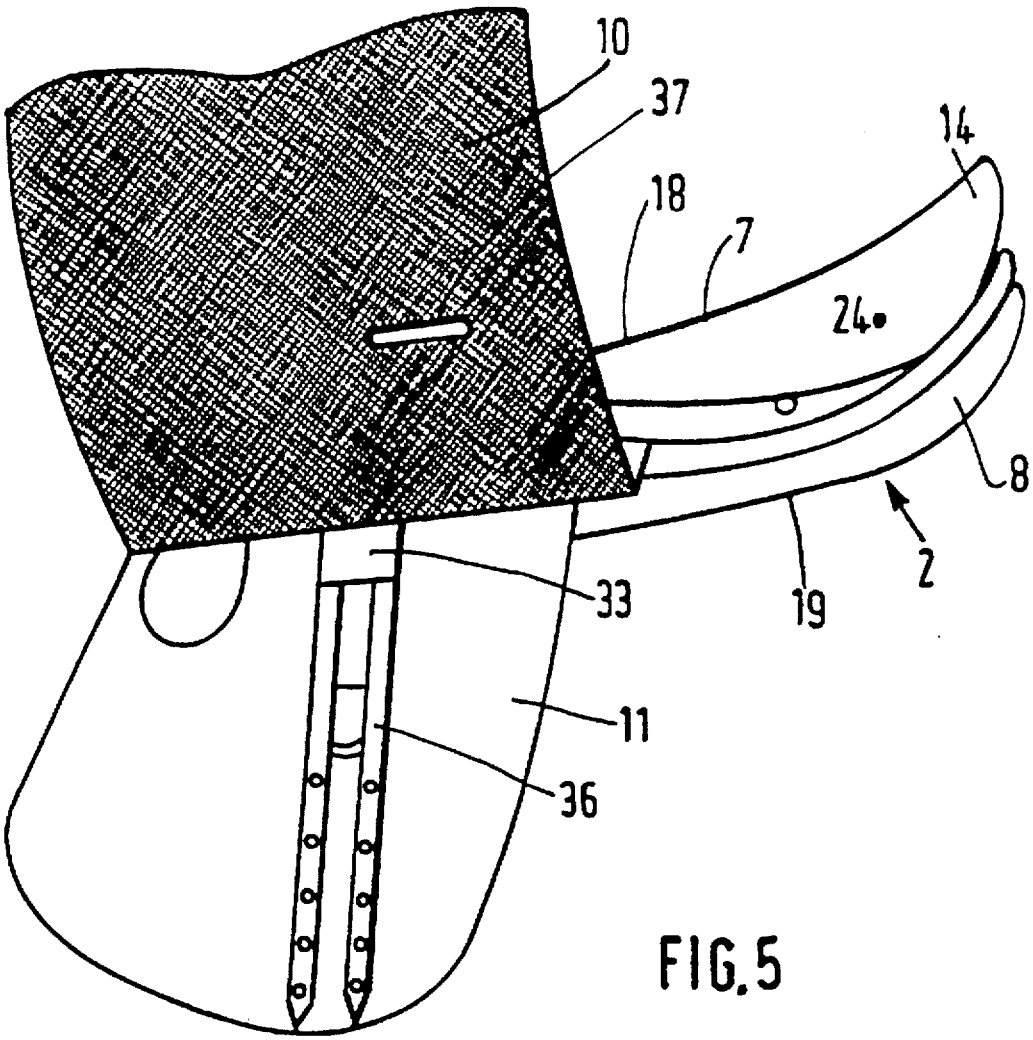

A saddle 1, in accordance with a first alternate embodiment of the invention and such as shown in the drawings, includes a saddle proper or saddle body 2, to which are associated a girth 3, stirrup leathers 4 and an overgirth 5.

The overgirth 5 described herein is intended to be positioned like the girth 3. It is more or less parallel to it and is intended to rest against the horse's belly.

The saddle proper 2 includes, in particular, a rigid inner saddle-bow 6, a seat 7, a panel 8, two skirts 9, two flaps 10 and two knee rolls 11, the three of them being lateral, superposed and respectively located from the outside to the inside of the saddle 1.

The saddle-bow 6 defines a front tree 12, a pommel 13 and a cantle 14, on the saddle.

Two stirrup leather arches 15 are laterally attached to the saddle-bow 6 at the front tree 12 and pommel 13.

In general, the shape and disposition of the elements making up the saddle 1 as it has just been described, may be modified in alternate embodiments depending on the goals pursued, the horse's morphology and the requirements of the person who will be riding it.

The saddle 1 displays a symmetrical plane P overall.

When the saddle is placed on the horse's back, or in a normal stand-by position, plane P is vertical or substantially vertical whereas seat 7, although it is bent with concavity turned upwards, has a generally horizontal direction. In this situation, seat 7 is turned upwards, panel 8 is turned downwards, and skirts 9, flaps 10 and knee rolls 11 are falling downwards (as shown in the drawings).

In the text, the terms "upwards", "downwards", "upper" and "lower" refer to this position. Besides, the term "outer" refers to what is on the outside of the saddle, i.e. opposite to the horse which the saddle is placed on. What is generally on the same side as the observer looking at the saddle from the outside is considered as outer. The term "inner" is opposed to "outer". The term "crosswise" refers to an overall direction perpendicular to or substantially perpendicular to plan P. The term "vertical" refers to a general direction perpendicular to or substantially perpendicular to the seat 7 in its mid-portion. The vertical direction is depicted in the figures by line D. As for the term "longitudinal", it refers to a substantially horizontal overall direction parallel to plane P (therefore from the pommel 13 to the cantle 14).

According to the invention, saddle 1, 2 includes a single passage 16 for overgirth 5.

This support passage 16 crosses, on the one hand, plane P, i.e. its two ends are provided with two openings 17, and, on the other hand it is transversal with respect to plane P.

Passage 16 is provided in saddle-bow 6 above the upper outer side 18 of seat 7 and above the lower inner side 19 of panel 8.

Passage 16 is thus totally built into saddle 1. This is also true for overgirth 5.

Passage 16 has two main purposes.

Its first purpose is to allow the guided transversal passage of overgirth 5 from one side of saddle 1 to the other, and, given the incorporation of overgirth 5 in the saddle, to avoid the extra thickness with respect to seat 7 currently encountered. Furthermore, passage 16 ensures a transversal guiding of overgirth 5 and its longitudinal positioning. The latter, which is defined by the relative position of passage 16 on the saddle proper 2, is optimised for a better support. Since it is guided by passage 16, overgirth 5 cannot shift longitudinally and relatively with respect to saddle 2, the optimum position thus being preserved.

Its second purpose is to provide, for overgirth 5, a vertical downwards support on the saddle proper 2 and more particularly on the saddle-bow 6.

Saddle-bow 6 includes a strengthening frame made of wood and metal in particular, including two rigid longitudinal strips 20.

Both strips 20 are rigidly joined together at cantle 14. On the opposite side, they are rigidly joined to tree 12, substantially at mid-height and substantially along an orthogonal direction.

A free and empty gap is provided between the two strips 20.

Two crossed straps 22 having a longitudinal overall direction are stretched over and above the saddle-bow frame 6 between the pommel 13 and the cantle 14, where they are respectively attached by means of nails 22*a*, for example. Girths 22 are placed in the bending of saddle-bow frame 6.

The frame 6 also includes an inlaid upper cloth 23 stretched onto straps 22 and attached to the strips 20 of saddle-bow frame 6 by means of nails or equivalent means.

A seat made of padded felt or an equivalent material (not shown) is placed on straps 22 and cloth 23, and profile-shaped pieces are placed beneath if if necessary.

A piece made of leather or an equivalent material 24 covers the felt seat and for an outer observer forms the seat 7.

The assembly is attached to saddle-bow 6 by means of nails 25.

Skirts 9 are sewn on either side of piece 24. A piece made of leather or an equivalent material 26 is attached to each of them and to piece 24, placed towards the inside of the saddle and partly covered by the upper free edge 27 of the corresponding flap 10.

The above-mentioned sewing, as well as the other needlework performed on the saddle, is preferably of saddler's sewing type.

Passage 16 is defined and limited at the top by straps 22. It is defined and limited at the bottom by strips 20. Lastly, it is limited at the pommel 13 and the cantle 14 by braces 28, 29 respectively.

Braces 28, 29 are interposed between and in contact with strips 20 and straps 22 respectively. Braces 28, 29 ensure the required spacing between strips 20 and straps 22, which defines the height of passage 16. The width -in the longitudinal direction-of passage 16 is defined by the spacing between the two braces 28, 29.

It is also provided that the same crossing strap 30 be attached to the strips 20 of the frame, underneath for example, by means of nails 30*a* or an equivalent means. This strip 30 covers straps 20, at least towards the top. This strap 30 joins together both strips 20 of saddle-bow frame 6 by closing the passage 16 downwards.

The material which strap 30 is made of is suitable for the passage, the support, and the sliding of overgirth 5. It consists of leather or an equivalent material.

Braces 28, 29 consist of full blocks properly cut, made of a sufficiently rigid plastic or an equivalent material;

Braces 28, 29 extend crosswise so as to rest on the two longitudinal straps 20 of saddle-bow frame 6.

Therefore, passage 16 is closed upwards by straps 22, at the pommel 13 and the cantle 14 by braces 28, 29 respectively. Strap 30 partly covers braces 28, 29. They are associated by sewing 34 or an equivalent means (gluing for example).

Passage 16 is only opened where its two side openings 17 have been provided.

These openings are substantially located in the jacket formed by the saddle-bow 6 in two plans symmetrical with respect. to plane P, and sloping upwards with respect to it.

The transversal cross section (with respect to its axis), of passage 16 has a substantially rectangular or pseudorectangular shape. Its dimensions, i.e. the smaller dimension in height and the larger dimension in the longitudinal direction, are greater than the corresponding dimensions of overgirth 5 (along its transversal cross section) to allow for the free passage of overgirth 5, with a required but non-excessive clearance.

Lengthwise—along the crosswise direction—, passage 16 is bent with concavity turned downwards, openings 17 being in a lower position and the mid-portion of passage 16 in an upper position. This arrangement facilitates the positioning of overgirth 5.

The two strips 20 of the frame slope downwards and towards the outside of the saddle. This slope determines that of the openings 17 mentioned above. As they are adjacent to openings 17 whose delimitation they contribute to, the two strips 20 form a guiding face for introducing overgirth 5 into passage 16. This arrangement also facilitates the introduction of overgirth into passage 16 whereas access to openings 17 may seem difficult or hardly possible since they are located under skirts 9.

Cloth 23 is conveniently cut so as to provide the passage 16 and leaves its openings 17 uncovered. The same is done for the seat made of felt or an equivalent material.

As for piece 26, it is cut so as to include a tongue 31 towards the bottom, which is folded inside passage 16 and towards the top of the latter.

The two tongues 31 (for the two pieces 26) are thus spaced, above and opposite strap 30. They also contribute to facilitating the introduction of overgirth 5 into passage 16 and its crosswise sliding.

A tongue 31 has its free edge interposed between strips 22 and the seat made of felt or an equivalent material. Besides, a tongue 31 is also rigidly joined to the body of saddle 2 by means of glue or an equivalent means.

Figure 15:
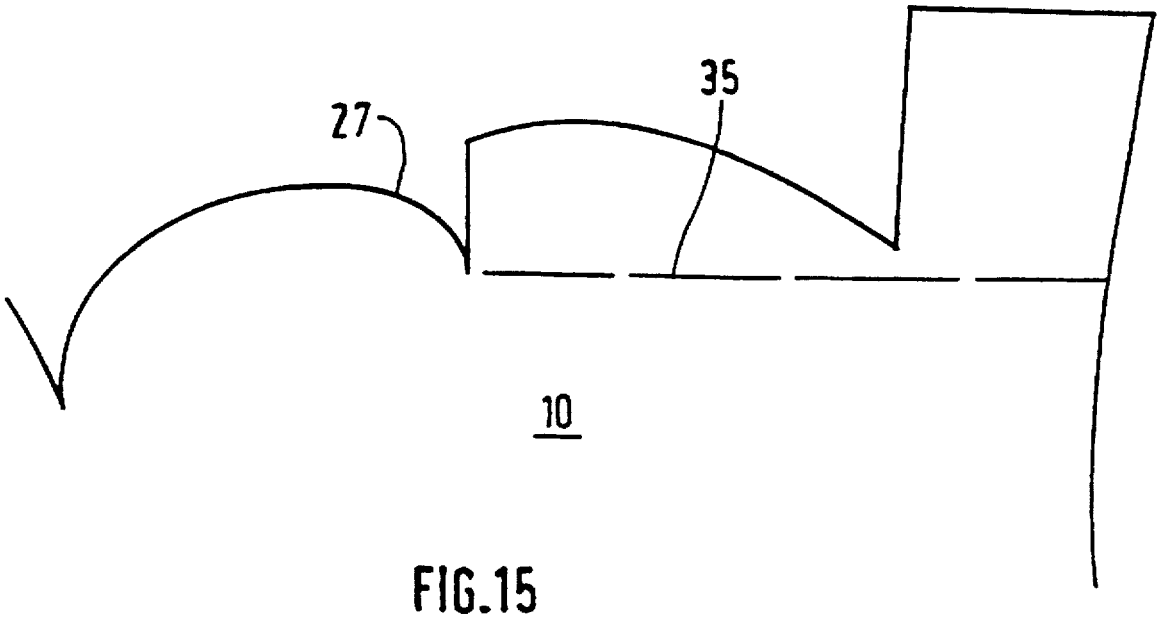
FIG. 15 is a partial detailed view in a larger scale, showing the piece forming the flap at its upper free edge.

As for the two flaps 10, their respective upper free edges 27 are also cut and/or folded to leave both openings 17 uncovered. For example (FIG. 15), each flap 10 is folded along line 35 (dotted line) which runs just below opening 17.

Passage 16 is located in or near the transversally narrowest mid-portion of saddle-bow 6. The longitudinal position of passage 16 is determined for a maximum efficiency of overgirth 5.

It is to be noted that this longitudinal position can be adjusted by adjusting the position of braces 28, 29 longitudinally.

This makes it possible to achieve a saddle perfectly suited to the horse's morphology and meeting the requirements of the person who is going to ride it, as well as those of the activity.

Openings 17 are normally concealed by skirts 9 located above them. Particularly, openings 17 are located near the lower free edges 32 of skirts 9.

In the first alternate embodiment considered, passage 16 is adjacent to the crossing strap 33 located towards pommel 13 and cross-covering straps 22.

Strap 33 is attached to strips 20 of saddle-bow frame 6 by means of nails 33*a* or equivalent means.

Fastening means 36 are provided at both ends of strap 33 for the removable fastening of girth 3. Such means are rings or girths, for example, or any other means.

In this situation, strap 33 covers brace 28 and is placed at right angles with respect to it.

Similarly, the cloth 23 covers brace 29 and is placed at right angles with respect to it.

Thus, going from the pommel 13 to the cantle 14, along straps 22, one successively comes across the tree 12, the stirrup leather arches 25, the strap 33 and the brace 28 below it, passage 16 and strap 30 below it, and eventually cloth 23 and below it brace 29.

This first alternate embodiment is more specifically intended for the game of polo. Indeed, with the overgirths 5 built into the saddle 1, the saddle 1 is perfectly fastened onto the horse. The polo plyer's safety and comfort are thus increased.

In this embodiment, a slit or a loop 37 is preferably provided for overgirth 5, in the flap substantially located at the base of passage 16 of overgirth 5, approximately at mid-height.

Figure 6:
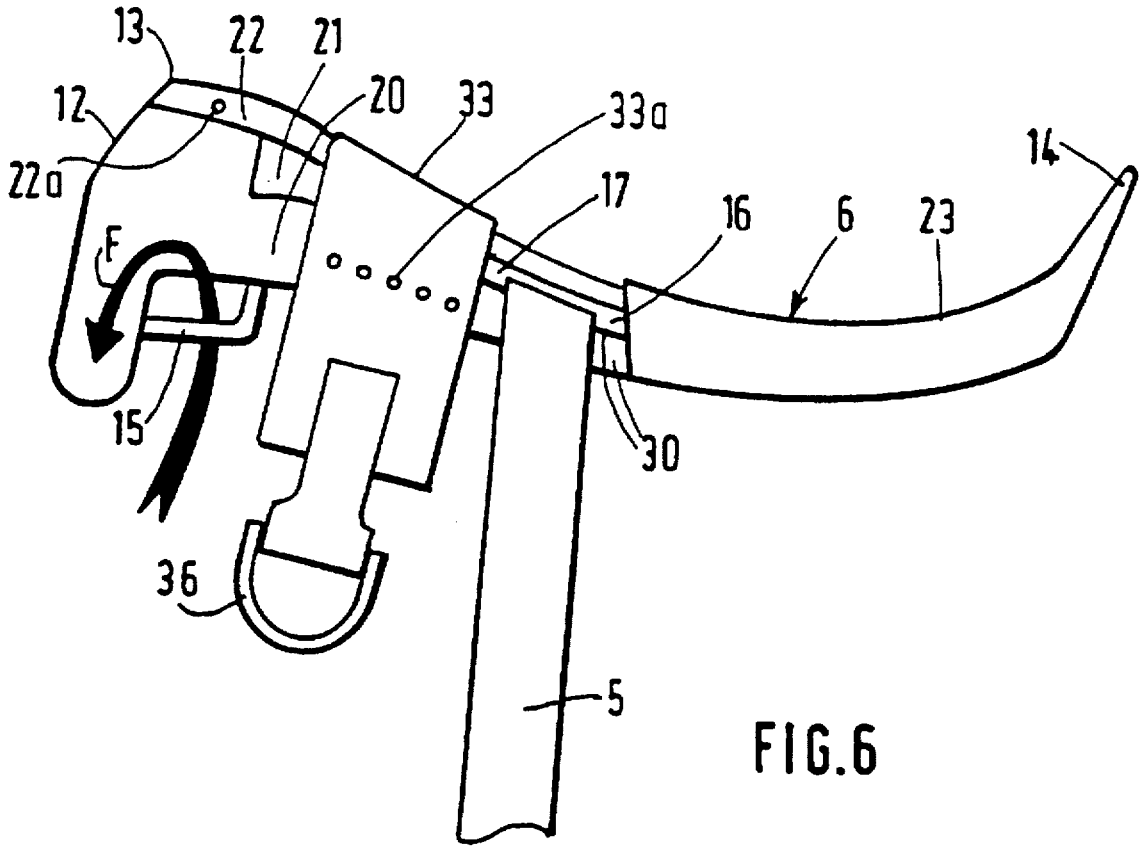
FIGS. 6 and 7 are two side elevation views showing the saddle-bow according to the invention and FIGS. 3 to 5, respectively with and without an overgirth.
Figure 7:
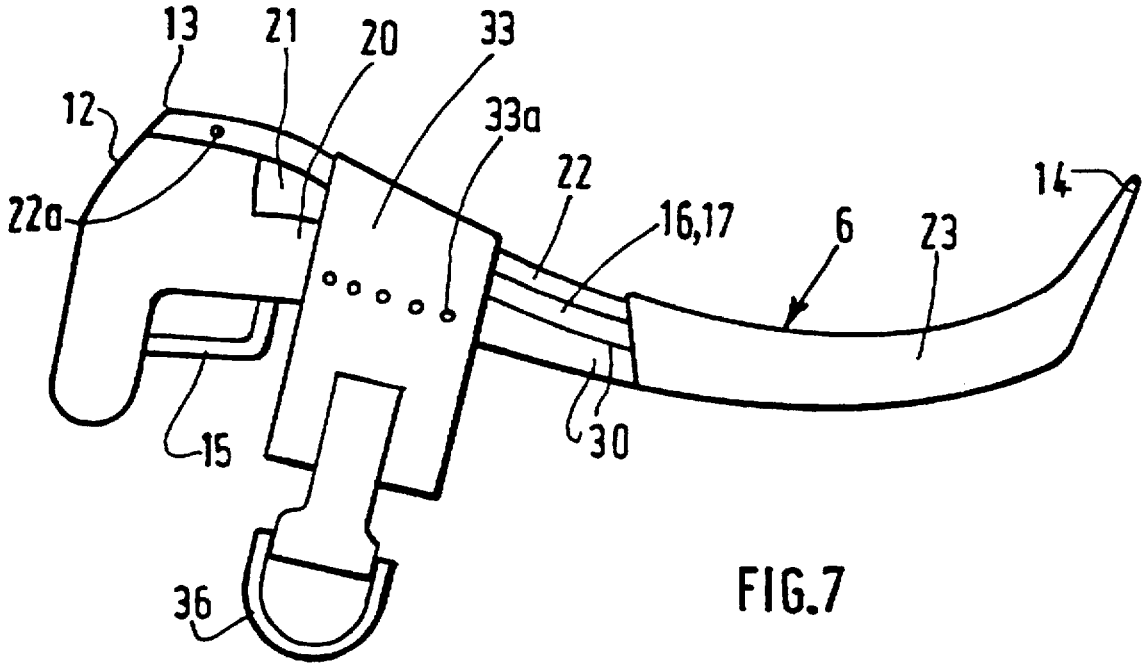
Figure 8:
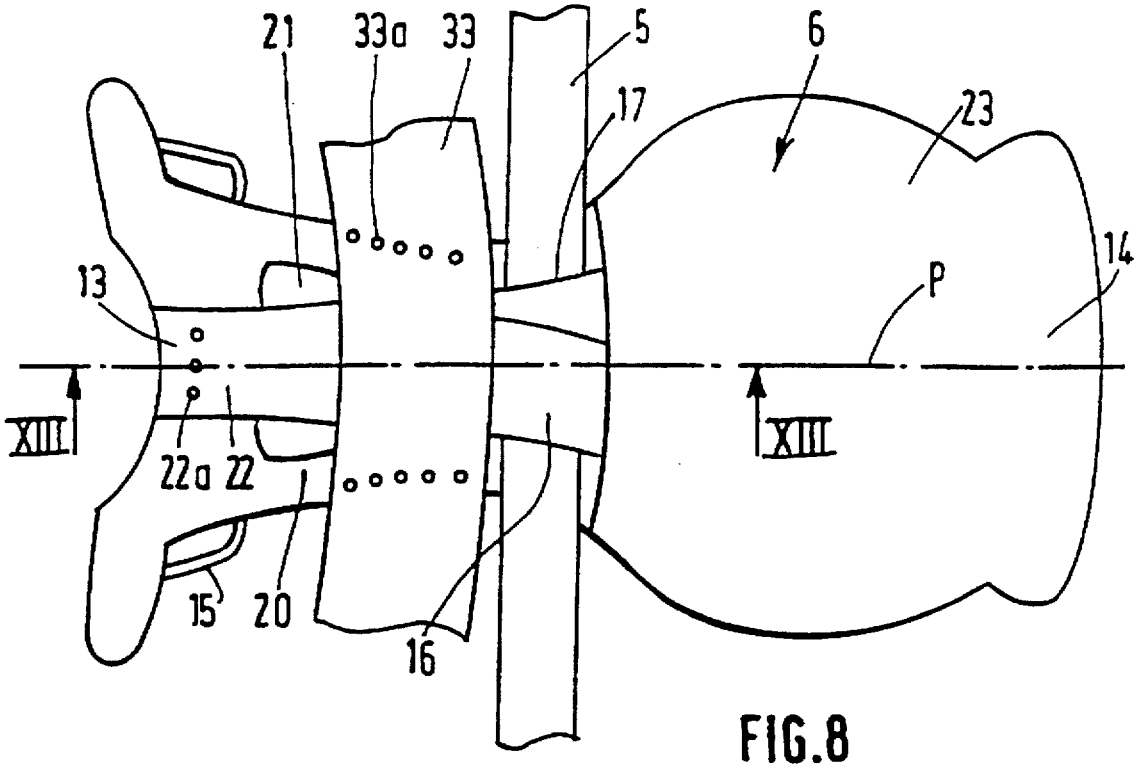
FIGS. 8 and 9 are two top views of the saddle-bow according to FIGS. 6 and 7.
Figure 9:
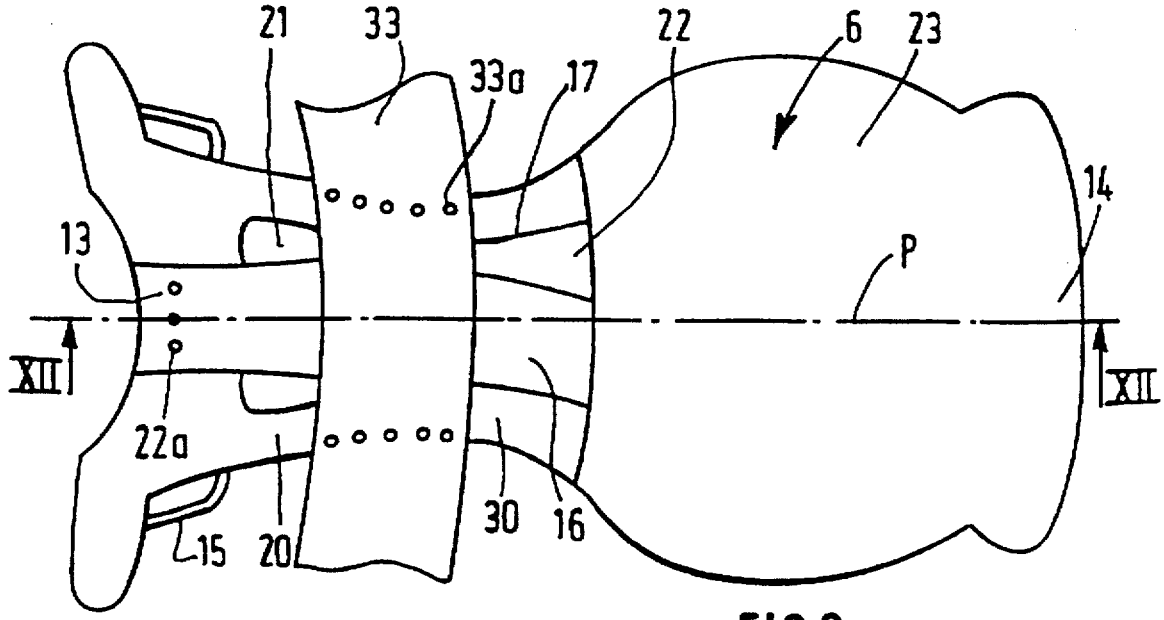
Figure 10:
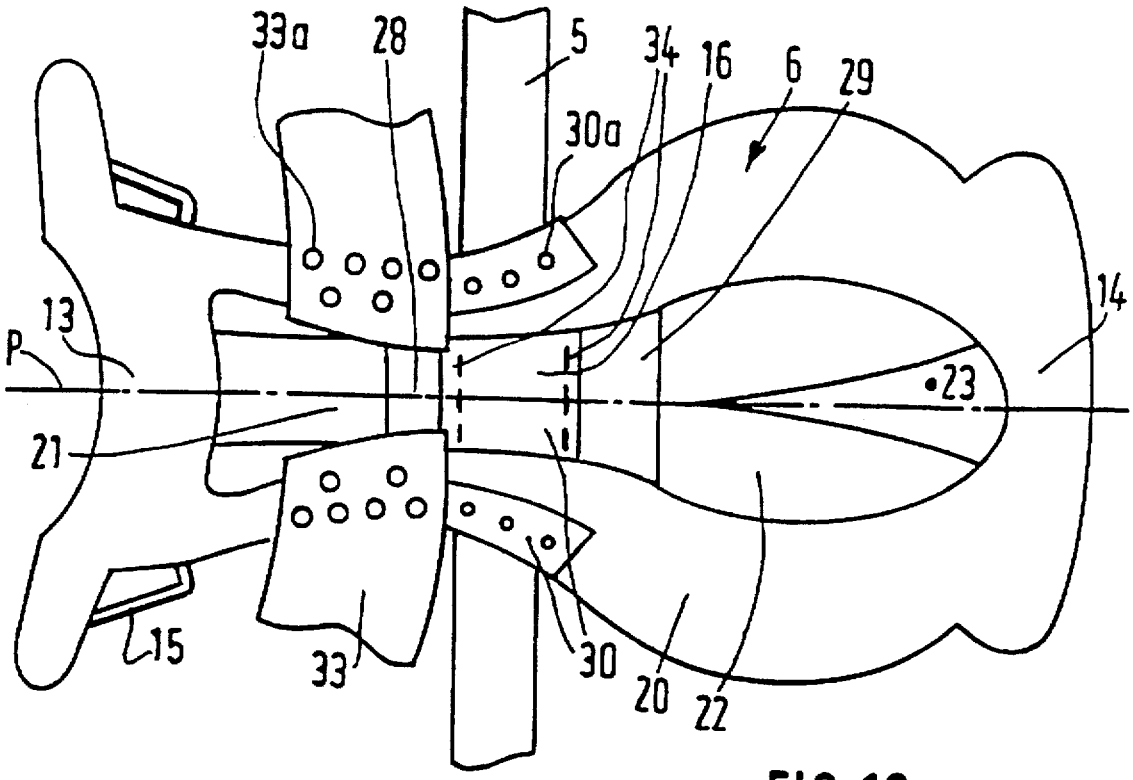
FIGS. 10 and 11 are two bottom views of the saddle-bow according to FIGS. 6 and 7.
Figure 11:
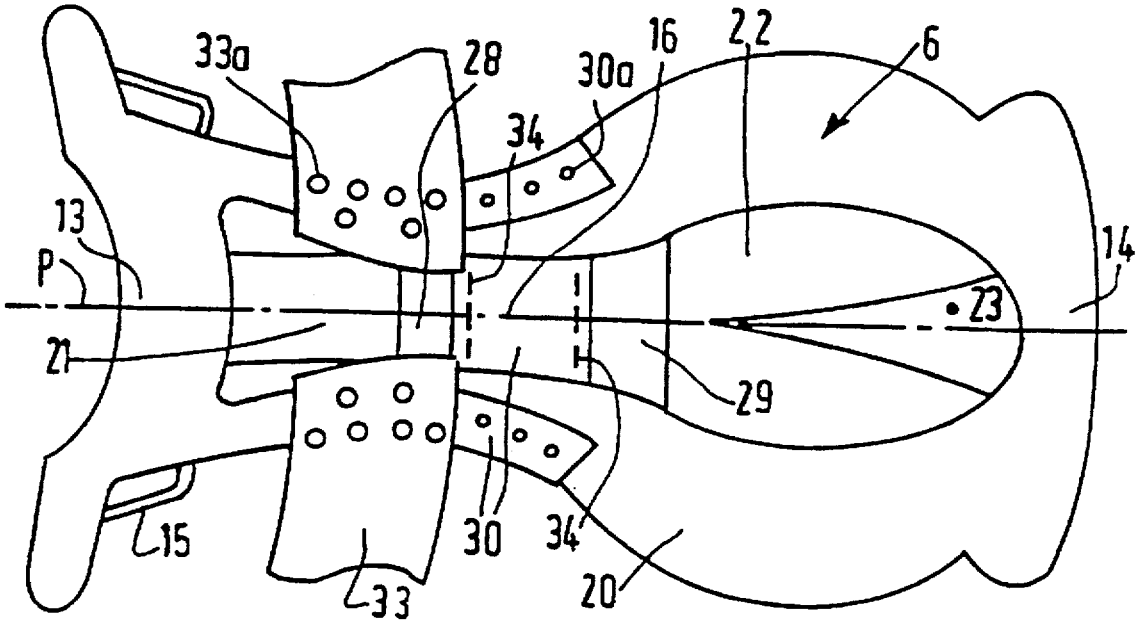
Figure 12:
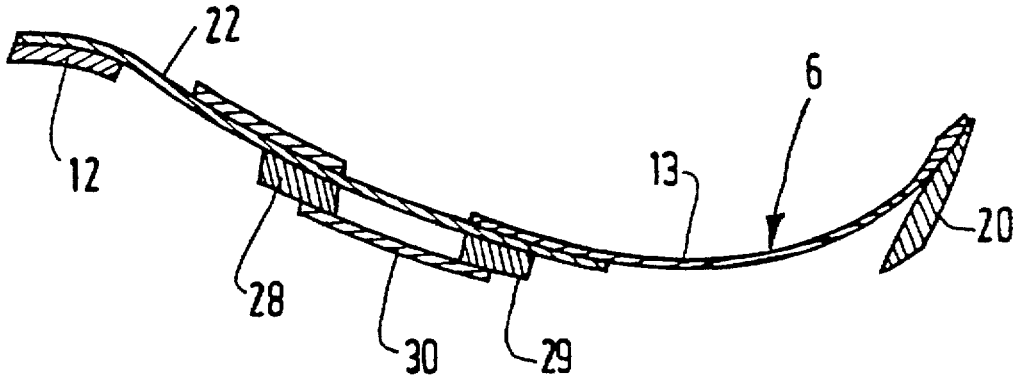
FIGS. 12 and 13 are two sectional views taken along lines XII—XII and XIII—XIII of FIGS. 9 and 8, respectively, FIG. 13 being shown in a larger scale.
Figure 13:
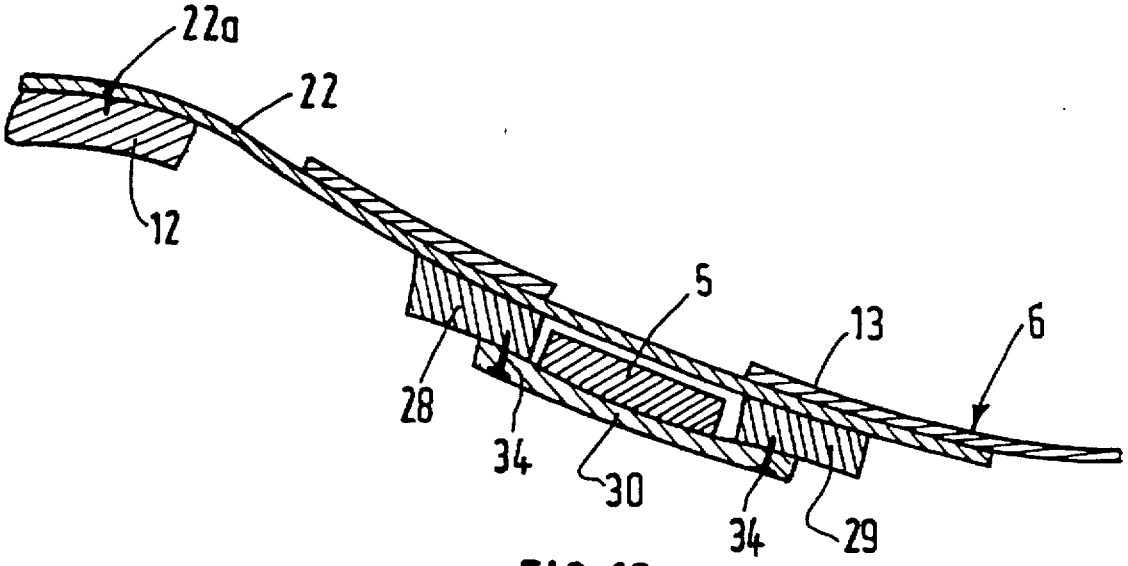
Figure 14:
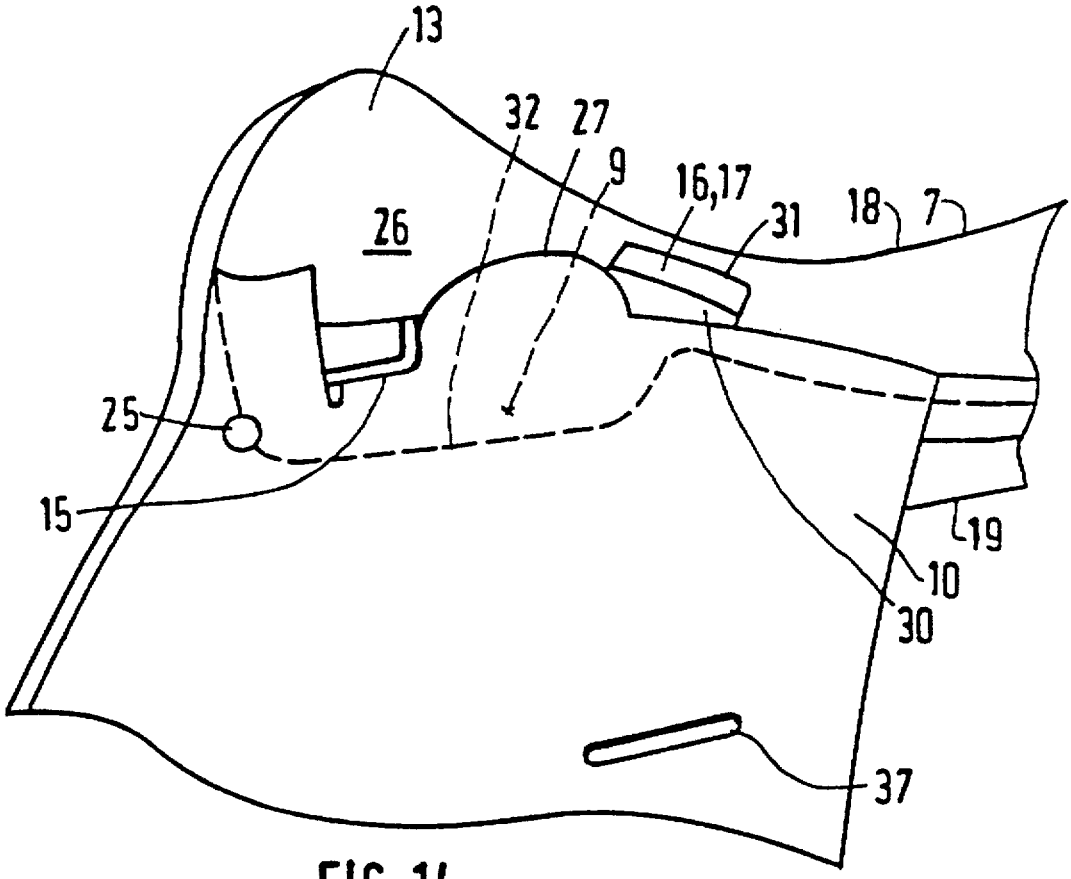
FIG. 14 is a partial detailed view corresponding to FIG. 4, the skirt being turned downwards but shown in dotted lines.

Furthermore, in order to avoid any untimely release of the stirrup leather 4 from its arch 5, an L-shaped stirrup leather arch is preferably provided. Combined with saddle-bow 6 to which it is associated at its two free ends, the stirrup leather arch 15 forms a passage closed throughout its entire periphery. In this embodiment, the passage of stirrup leather 4 is possible only as a result of a bottom-to-top motion between the stirrup leather arch 15 and flap 10 in said passage closed throughout its periphery. (Refer to arrow F in FIG. 6).

Under these conditions, the slit or loop 37 provided for overgirth 5 can also serve as a slit or a loop for stirrup leather 4.

Reference is made once again to FIG. 1 which illustrates overgirth 5 built into the thickness of saddle 1, and which, thus positioned, crosses passage 16, emerges from its two side openings 17, is placed on the visible outer face of both flaps 10 between said openings and the slits or loops 37, and is placed under both flaps 10, thus concealed between the slits or loops 37 and the lower free edges 38 of flaps 10.

The respective dimensions of passage 16 and overgirth 5, i.e. the small dimension in height (thickness of overgirth 5) and large dimension in the longitudinal direction (width of overgirth 5) are related to one another so as to allow for the introduction, the sliding motion for the passage, and the guiding, without any possibility of substantial relative longitudinal shift of overgirth 5 within or with respect to passage 16.

Furthermore, since overgirth 5 is concealed by flaps 10 below the slits or loops 37, it is not, at that point, a source of discomfort for the inner sides of the thighs of the person who is riding the horse. Indeed, it does not form an extra thickness.

According to a second alternate embodiment, which is not shown, the saddle has a single passage 16 for girth 3, and this passage 16 being located much closer to the pommel 13 and stirrup leather arches 15 farther away from the cantle 14, as compared to the passage described for the first alternate embodiment.

The passage 16 thus considered is placed at right angles with respect to strap 33, as described in the first alternate embodiment.

Strap 33, is placed in passage 16 provided for this purpose, free to slide transversally, instead of being fixed to saddle-bow. 6 as in the first alternate embodiment.

In this second alternate embodiment, saddle 1 therefore further includes, a girth 3 built into the thickness of saddle 1. This girth 3 is either of conventional type and is attached on strap 33, of conventional type itself, by means of fastening means provided for this purpose; or strap 33 is "merged" with strap 3.

If an overgirth is to be used in this second alternate embodiment, it is used as per common practice, as extra thickness on seat 7 and flaps 10.

Figure 16:
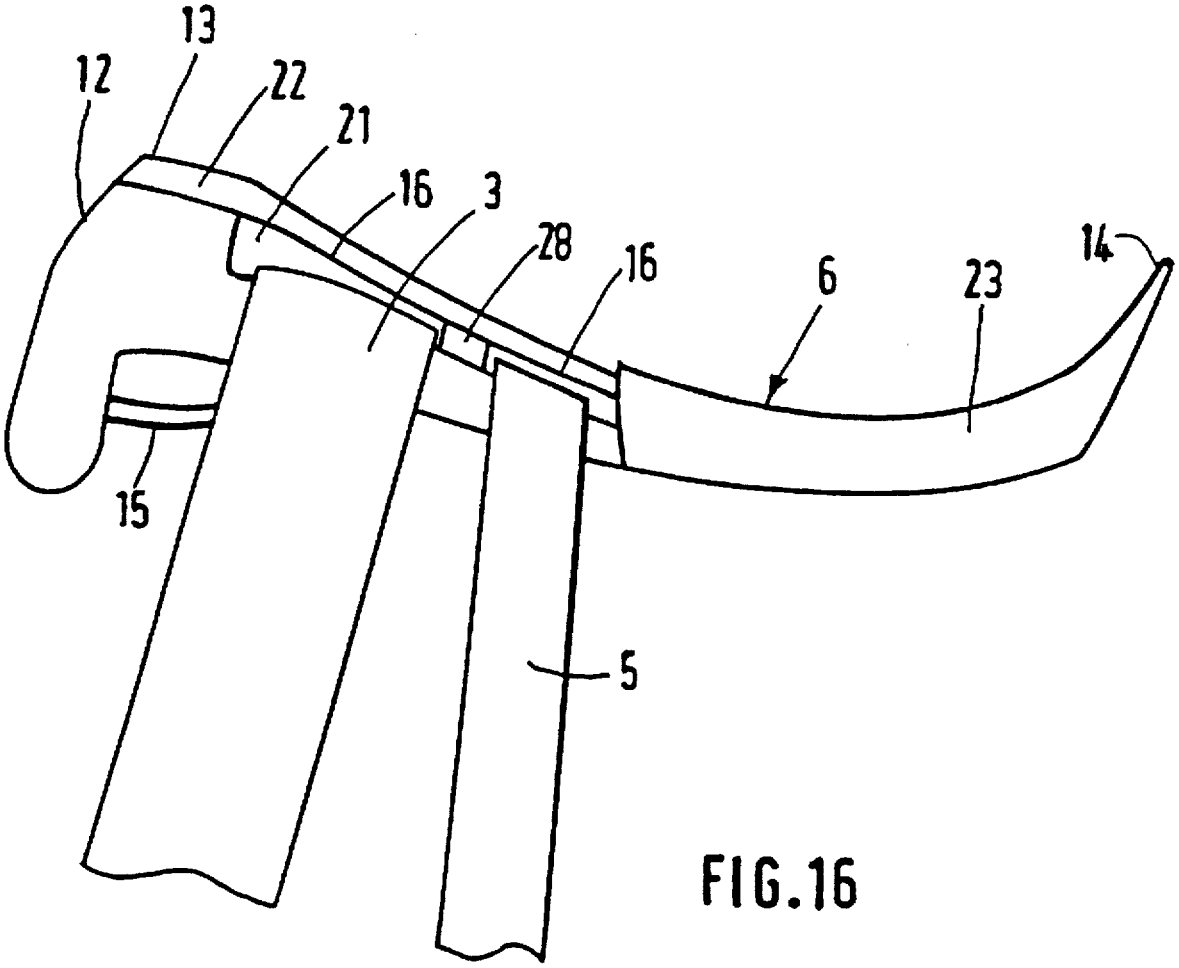
FIG. 16 is a view similar to FIG. 6, corresponding to a third alternate.

In a third alternate embodiment shown schematically in FIG. 16, saddle 2 includes a single or a double passage for girth 3 and overgirth 5.

Saddle 1 then further includes a girth 3 and an overgirth 5, both built into the thickness of saddle 1.

If girth 3 or overgirth 5 is built into saddle, this girth 3 or overgirth 5 can be of the type including an elastic portion.

Although the above description has been made in relation to leather pieces, these can be made of substitute leather, or any other equivalent material.

According to another respect, the invention concerns a method for making a saddle as described above.

This method is such that during the manufacturing and assembly of the saddle, at least one crossing, transversal passage 16 is provided in the saddle-bow 6 by properly cutting and/or folding the felt seat, cloth 23, piece 26 and free edge 27 of flap 10 and by interposing braces 28, 29 between the strips 20 of the saddle-bow 6 frame and straps 22.

I claim:

1. A saddle for a horse comprising a seat (7) which has an upper outer face (18), longitudinal straps (22), longitudinal strips (20), a saddle-bow (6), a pommel (13), and a cantle (14), characterized by at least one support passage (16), provided below an upper outer face (18) of a seat (7) totally built into the saddle, whose functions are the guided transversal passage from one side to another, on the one hand and, the vertical downwards support, on the other hand, of at least one girth (3) or overgirth (5) which is slidable relative to said saddle.

2. A saddle according to claim 1, characterized in that it includes a single passage (16) for one girth (3) or one overgirth (5).

3. A saddle according to claim 1, characterized in that at least one passage (16) is provided above a lower inner side (19) of a panel (8) associated with the seat (7).

4. A saddle according to claim 1, characterized in that at least one passage (16) is provided in the saddle-bow (6).

5. A saddle according to claim 1, characterized in that said at least one passage (16) is defined towards the top by longitudinal straps (22) attached to the saddle-bow (6); towards the bottom by the longitudinal strips (20) of the saddle-bow (6); towards the pommel (13) and the cantle (14) by braces (28, 29), respectively, ensuring spacing between the longitudinal strips (20).

6. A saddle according to claim 5, characterized in that, within at least one said passage (16), the longitudinal strips (20) of the saddle-bow (6) are covered, at least towards the top, with a material suitable for the passing, sliding and resting of a girth (3) or overgirth (5).

7. A saddle according to claim 6, characterized in that the longitudinal strips (20) are joined together by means of a strap (30) attached to said strips (20) of the saddle-bow, made of a material suitable for the passing, sliding and resting of a girth (3) or an overgirth (5).

8. A saddle according to claim 6, characterized in that a single strap (30) made of leather covers both longitudinal strips (20) of the saddle-bow (6) and joins them by closing at least one passage (16) towards the bottom.

9. A saddle according to claim 5, characterized in that braces (28, 29) are made up of blocks properly cut, made of plastic material.

10. A saddle according to claim 9, characterized in that the braces (28, 29) extend transversally so as to rest on both longitudinal strips (20).

11. A saddle according to claim 5, characterized in that said at least one passage (16) is closed at the top, at the bottom, towards the pommel (13) and towards the cantle (14) and is provided with only two side openings (17) substantially located within a jacket formed by the saddle-bow (6).

12. A saddle according to claim 5, characterized in that the saddle-bow (6) includes an inlaid upper cloth (23) cut so as to provide said at least one passage (16) and to leave said side openings (17) uncovered.

13. A saddle according to claim 5, characterized in that, on each of a pair of skirts (9), a piece of leather (26) is placed towards the inside of the saddle and is partially covered by an upper free edge (27) of a flap (10), this piece (26) including a tongue (31) which is cut and folded within at least one said passage (16) and towards the top.

14. A saddle according to claim 13, characterized in that said tongue (31) is rigidly joined to the saddle by gluing.

15. A saddle according to claim 13, characterized in that a free edge of said tongue (31) is interposed between the longitudinal straps (22) and a seat made of felt.

16. A saddle according to claim 15, characterized in that the openings (17) of said at least one passage (16) are located near lower free edges (32) of said skirts (9).

17. A saddle according to claim 5, characterized in that side openings (17) of said at least one passage (16) are normally concealed by skirts (9).

18. A saddle according to claim 1, characterized in that said at least one passage (16), has a profile-shape having, in its transversal cross section, a substantially rectangular outline; and a curved overall shape, side openings (17) being located in a lower position and a central mid-portion being located in an upper position.

19. A saddle according to claim 1, characterized in that said at least one passage (16) is located in, or near a transversally narrowest mid-portion of said saddle-bow (6).

20. A saddle according to claim 1, characterized in that it includes a single passage (16) for an over-girth (5) adjacent to a transversal strap (33) located towards the pommel (13) and covering the longitudinal straps (22) of the saddle-bow (6), said strap (33) being adapted for the removable fastening of a strap (3) to said saddle (1).

21. A saddle according to claim 20, characterized in that a block-shaped brace (28) is placed at right angles with respect to said transversal strap (33).

22. A saddle according to claim 20, characterized in that a slit (37) is provided in a flap (10) for the overgirth (5), substantially located at the base of said passage (16) of the overgirth (5).

23. A saddle according to claim 22, characterized by an L-shaped stirrup leather arch (15) which allows the passage of only a stirrup leather (4) as a result of relative vertical movement between the stirrup leather arch (15) and said flap (10), within a passage closed about its entire periphery.

24. A saddle according to claim 20, characterized in that a slit (37) for the overgirth also serves as a slit for a stirrup leather (4).

25. A saddle according to claim 20, characterized in that it further includes an overgirth (5) built into the thickness of the saddle (1) , which crosses said at least one passage (16), emerges from two side openings (17), is placed on a visible outer face of two flaps (10) between slits (37) and the said openings (17), and is located under both said two flaps (10), thus concealed between said slits (37) and lower free edges (38) of said flaps (10).

26. A saddle according to claim 25, characterized in that the overgirth (5) does not create an extra thickness with respect to said seat (7) or said flaps (10) below the slits (37).

27. A saddle according to claim 1, characterized in that it includes a single passage (16) for the at least one girth (3), this passage (16) being located towards the pommel (13) and stirrup leather arches (15).

28. A saddle according to claim 27, characterized in that it further includes a said girth (3) built into the thickness of the saddle (1).

29. A method for making a saddle (1) according to claim 1, characterized in that, during its manufacture and assembly, said at least one passage (16) is provided in the saddle-bow (6) by properly cutting and folding a felt seat, a cloth (23), a piece (26) and a free edge (27) of a flap (10), and by interposing braces (28, 29) between the strips (20) and said longitudinal straps (22).

* * * * *